United States Patent [19]

Peelle et al.

[11] Patent Number: 4,667,913

[45] Date of Patent: May 26, 1987

[54] DEVICE FOR SUSPENDING OBJECTS

[75] Inventors: Angela A. Peelle, Chicago, Ill.; Charles G. Vaughn, Jr., Rutherford, N.J.

[73] Assignee: Clevepak Corporation, Purchase, N.Y.

[21] Appl. No.: 857,832

[22] Filed: Apr. 30, 1986

[51] Int. Cl.[4] ..... A47B 96/06

[52] U.S. Cl. ..... 248/228; 248/302; 248/317

[58] Field of Search ..... 248/228, 231.7, 72, 248/227, 302, 303, 343, 340, 317, 318, 214, 215, 231.8; 52/39; 24/533, 547, 551, 570

[56] References Cited

U.S. PATENT DOCUMENTS

| | | | |
|---|---|---|---|
| 319,280 | 6/1885 | Lodge . | |
| 670,552 | 3/1901 | Brown | 248/328 |
| 1,139,908 | 5/1915 | Salkeld . | |
| 1,889,077 | 11/1932 | Russell | 248/228 |
| 2,513,759 | 7/1950 | Tarallo | 24/533 X |
| 3,327,376 | 6/1967 | Freeman et al. . | |
| 3,530,545 | 9/1970 | Lengyel | 248/317 X |
| 3,601,862 | 8/1971 | Hargadon | 248/317 X |
| 3,743,228 | 7/1973 | Drab | 248/228 |
| 3,936,913 | 2/1976 | Weissman | 248/228 X |
| 4,065,090 | 12/1977 | Mauney | 248/318 |
| 4,074,885 | 2/1978 | Hacker | 248/317 |
| 4,135,692 | 1/1979 | Ferguson | 248/317 X |
| 4,223,488 | 9/1980 | Schoenung | 248/228 X |
| 4,318,525 | 12/1979 | Welch . | |

FOREIGN PATENT DOCUMENTS

| | | | |
|---|---|---|---|
| 450009 | 9/1927 | Fed. Rep. of Germany | 248/214 |

*Primary Examiner*—J. Franklin Foss

*Attorney, Agent, or Firm*—Charles B. Smith

[57] ABSTRACT

An adjustable device for supporting objects, consisting of a clip means made from a single piece of resilient material and a suspending means made from a single piece of flexible material. The clip means comprises a mobile spring clip whose lower portion is in the form of a W. The suspending means may be connected to the clip means in the area where the arms of the spring clip cross or at the middle of the W. The length of said suspending means, and thus the height of the object from the ground, may be adjusted by winding the flexible material around the vertical axis of the clip means.

5 Claims, 6 Drawing Figures

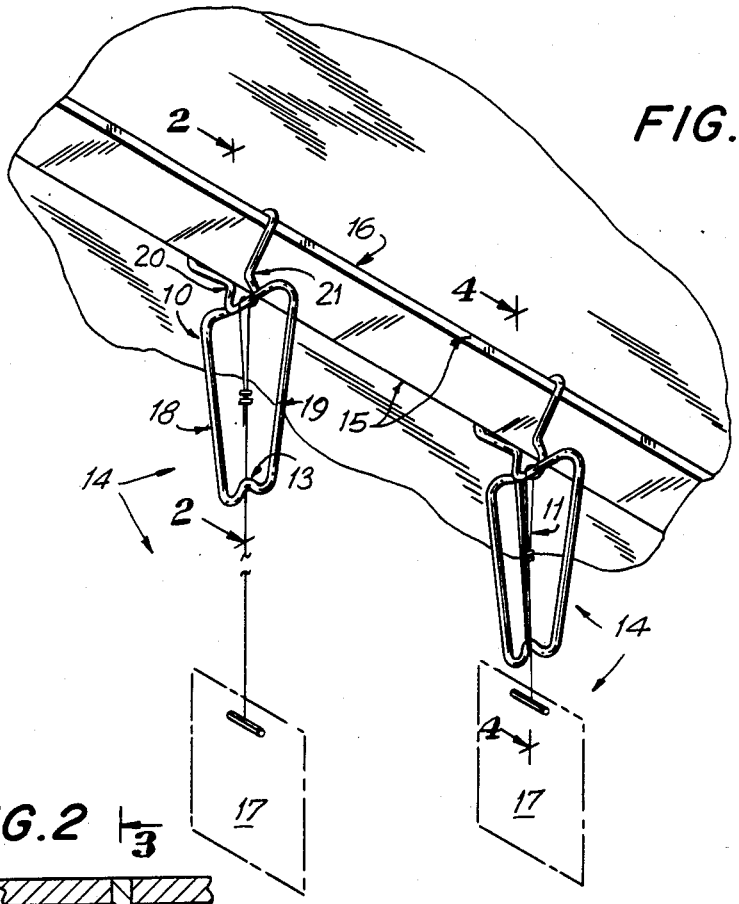
FIG. 1
FIG. 2
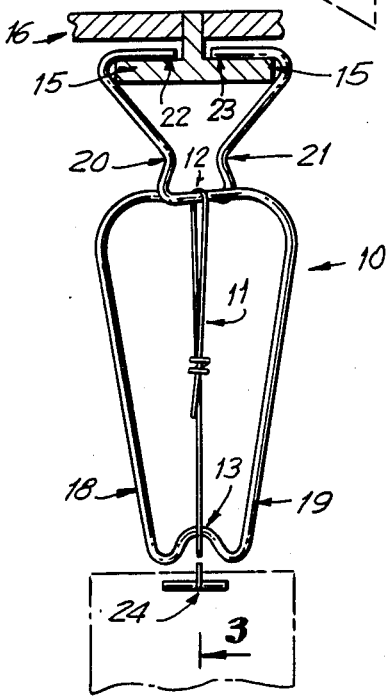
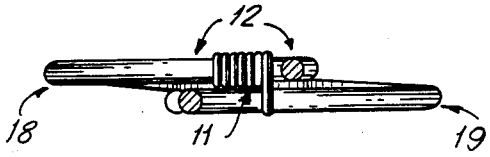
FIG. 5
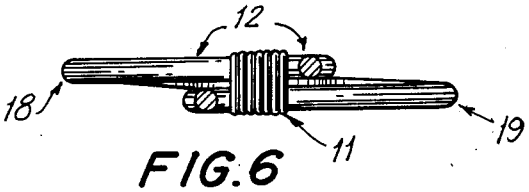
FIG. 6

DEVICE FOR SUSPENDING OBJECTS

TECHNICAL FIELD OF THE INVENTION

This invention relates to a device for suspending store displays or other objects, and more particularly, to a mobile spring clip incorporating an adjustable suspending means.

BACKGROUND OF THE INVENTION

Devices for supporting store displays and other objects are disclosed in the art. For example, Freeman et al. U.S. Pat. No. 3,327,376 describes a U-shaped device that engages a ceiling joist and supports an object attached to the lower U portion of the device. Welch U.S. Pat. No. 4,318,525 describes a loop-shaped device, with crossed legs capable of engaging a ceiling panel, which can support an object attached to the bottom of the loop.

An object supported by these prior art devices either is not easily removed from the clip means or cannot be readily lowered or raised because the devices do not incorporate a reusable, adjustable object suspending means. The absence of such means results in additional expenditures of materials and labor, for example, any time a store display is rearranged. Furthermore, prior art devices such as in U.S. Pat. No. 3,327,376 are apt to twist open and disengage from the ceiling runner if the weight of the supported objected is substantial.

SUMMARY OF THE INVENTION

It is therefore an object of the present invention to provide a device for suspending objects which can be attached to a ceiling runner, which incorporates an object suspending means that is reusable and adjustable to any desired length, and which is stable under higher loads.

According to the present invention, a device for supending objects is provided comprising a clip means and an object suspending means, the clip means comprising a mobile spring clip and the suspending means comprising a single piece of cord, wire or other material sufficiently strong and flexible to support the weight of a suspended object and to be wound around the spring clip. At one end, the suspending means is tied around the arms of the clip means. The length of the suspending means is shortened, and thus the distance of the display or other object from the ground is increased, by winding the suspending means around the vertical axis of the spring clip from the point at which the clip arms cross one another, to the bottom portion of the clip, and back.

BRIEF DESCRIPTION OF THE FIGURES

FIG. 1 is a fragmentary perspective view illustrating two objects suspended at different distances from a ceiling panel in accordance with the invention;

FIG. 2 is a frontal cross-section taken in the direction of section line 2—2 of FIG. 1, in which the object suspending means hangs freely;

FIG. 5 is a top view looking down on the structure illustrated in FIG. 4 below the line indicated by section line 5—5;

FIG. 6 is similar to the structure in FIG. 5 except that the object suspending means is wound around both crossed arms of the clip means.

DETAILED DESCRIPTION OF THE INVENTION

Figure 3:
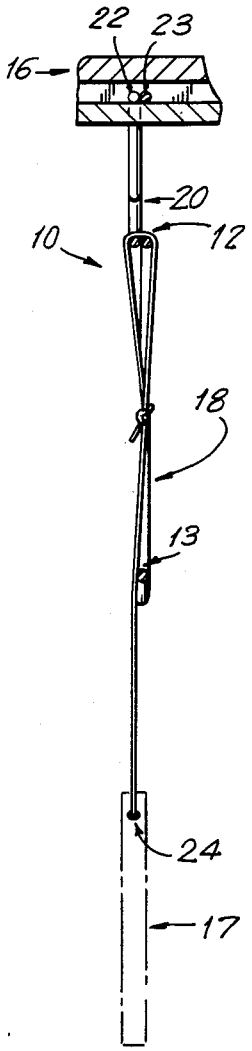
FIG. 3 is a side view of the structure in FIG. 2 along the direction of section line 3—3 of FIG. 2.
Figure 4:
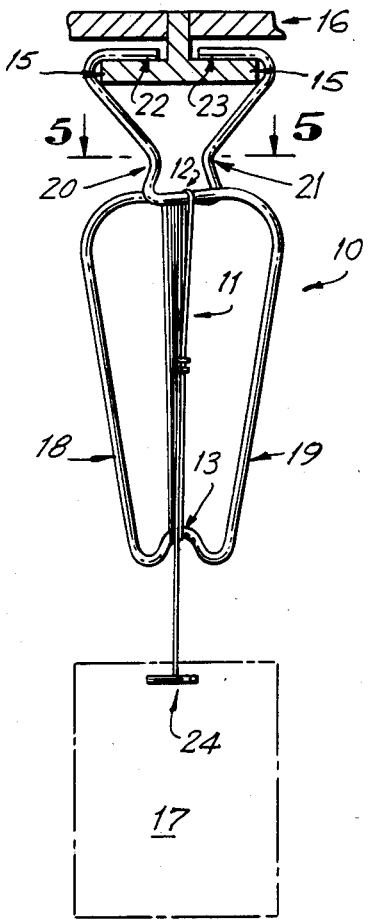
FIG. 4 is similar to the structure in FIG. 2 except that the object suspending means has been shortened by winding it around one arm of the clip means.

The adjustable display device of the present invention is shown generally in FIGS. 2 and 4. The device consists of a clip means 10 and an object suspending means 11. Although the embodiment shown in FIGS. 1–6 and described below shows suspending means 11 attached to clip means 10 at the region 12, where the arms of the clip traverse one another, suspending means 11 alternatively may be attached to the middle point 13 of the W shape formed by the lower portion of the clip means 10.

FIG. 1 shows two examples 14 of the adjustable display device. The devices engage the flanges 15 of a ceiling runner or joist 16 at a desired location and support objects 17. The interrupted lines below section line 2—2 indicate that the actual length of the supporting means of device 14 is greater than that shown. Object 17 suspended from the right hand device in FIG. 1 is closer to ceiling runner 16 because supporting means 11 has been wound several times around the vertical axis of the clip means.

FIG. 2 shows a frontal view of the device 14. Clip means 10 consists of a single piece of resilient material, such as spring wire, bent at the lower portion in the general shape of a W. At regions 18 and 19, the arms of the W extend upwardly and diverge from one another for a short distance. The arms are then bent inwardly and downwardly, such that they traverse one another in region 12. In this preferred embodiment, beyond the area of traverse the arms are bent successively inwardly and outwardly to form notches 20 and 21. The arms continue in an upward and outward direction until they are bent inwardly to form hooks at ends 22 and 23 for grasping flanges 15 of ceiling runner 16. Because of the resiliency of the clip material, lower portions 18 and 19 of the clip arms are biased outward in their normal state, thereby urging ends 22 and 23 toward one another and securing the clip around flanges 15. When the arms of the clip means are compressed at regions 18 and 19, ends 22 and 23 spread apart, permitting the clip to slide along ceiling runner 16 or to be removed altogether.

In FIG. 2 object supporting means 11 is a single piece of flexible material tied at one end around the arms of clip means 10 at region 12, where the arms are bent downwardly and traverse. The opposite end of supporting means 11 is attached to a short barb 24 which may be used for attaching the suspending means to an object. Of course, other means for attaching an object, such as a hook or ring, can be used instead of barb 24.

FIG. 4 is similar to FIG. 2 except that object 17 is closer to ceiling runner 16. This is accomplished by winding supporting means 11 around the vertical axis of clip means 10 from region 12 to point 13, and back around one of the horizontal arms at region 12. The W shape of clip means 10 serves to prevent suspending means 11 from slipping off the clip when it has been wound around said clip. The wound portion of the suspending means at region 12 remains in place due to the downward slope of each traversing arm. The winding of suspending means 11 around clip means 10 prevents the crossed arms of the clip from twisting open under the weight of heavy objects.

FIGS. 5 and 6 illustrate alternative ways in which suspending means 11 can be wound around clip means 10. In FIG. 5, the suspending means is looped around one traversing arm, whereas in FIG. 6 the suspending means is looped around both arms. In this second embodiment, suspending means 11 provides even more stability to the clip means under the weight of heavy objects.

The device of this invention permits a person to substitute a suspended object for another without having to disengage clip means 10 from its ceiling runner 16. Instead, it is only necessary to detach bar 24 (or other attachment means) from the suspended object. If it is desired to raise or lower the suspended object, there also is no need to remove the clip or to obtain a new length of suspending material. Is is sufficient simply to wind or unwind an appropriate length of suspending means 11 around clip means 10 to achieve the proper height.

Other modifications and variations of this invention will be apparent to those skilled in the art and the claims are intended to cover all such modifications and variations that fall within the true spirit and scope of the invention.

We claim:

1. A device for suspending objects from a ceiling runner or the like comprising:

(a) a clip means having generally the shape of a W at its lower region, the arms of said W shape extending upward and diverging from each other, said arms then curving inward and horizontally so that they cross and extend past one another in opposite directions, said arms then turning upward and outward, the ends of said arms being bent horizontally toward one another to form hook means for grasping the flanges of a runner, such that said ends spread apart when the arms of the W shape are compressed at their lower region and the ends move toward each other when said arms are released; and (b) an elongated, flexible suspending means attached at one end to the arms of said clip means at the region where said arms cross and extend past one another, said suspending means being wound around the vertical axis of said clip means at least one full turn and as many additional turns, if any, as may be required by the height of said ceiling runner and the desired height of an object to be suspended.

2. The device of claim 1 wherein the arms of said clip means are notched inward above the region where said arms extend past one another.

3. The device of claim 1 wherein said suspending means is attached to said clip means at its W shaped, lower region.

4. The device of claim 1 further comprising a member for connecting an object to said suspending means, which member is attached to the end of said suspending means opposite the end attached to said clip means.

5. A method for suspending objects comprising:

(a) providing a clip means adapted for attachment to a ceiling runner or the like, said clip means having generally the shape of a W at its lower region, the arms of said W shape extending upward and diverging from each other, said arms then curving inward and horizontally so that they cross and extend past one another in opposite directions, said arms then turning upward and outward, the ends of said arms being bent horizontally toward one another to form hook means for grasping the flanges of a runner, such that said ends spread apart when the arms of the W shape are compressed at their lower region and the ends move toward each other when said arms are released;

(b) attaching said clip means to said ceiling runner or the like;

(c) attaching one end of an elongated, flexible suspending means to the arms of said clip means at the region where the arms cross and extend past one another;

(d) winding said suspending means around the vertical axis of said clip means at least one full turn and as many additional turns, if any, as may be required by the height of said ceiling runner and the desired height of an object to be suspended; and (e) attaching said object to the other end of said suspending means.

* * * * *